US011333358B2

(12) United States Patent
Bunel et al.

(10) Patent No.: US 11,333,358 B2
(45) Date of Patent: May 17, 2022

(54) ONE-PIECE COMBUSTION CHAMBER

(71) Applicant: Safran Aircraft Engines, Paris (FR)

(72) Inventors: Jacques Marcel Arthur Bunel, Moissy-Cramayel (FR); William Louis Rodolphe Dousse, Moissy-Cramayel (FR); Dan Ranjiv Joory, Moissy-Cramayel (FR); Benjamin Frantz Karl Villenave, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 343 days.

(21) Appl. No.: 16/520,838

(22) Filed: Jul. 24, 2019

(65) Prior Publication Data

US 2020/0033004 A1 Jan. 30, 2020

(30) Foreign Application Priority Data

Jul. 25, 2018 (FR) ..... 1856919

(51) Int. Cl.

| | |
|---|---|
| ***F23R 3/00*** | (2006.01) |
| ***F23R 3/04*** | (2006.01) |
| ***F01D 25/08*** | (2006.01) |
| *F23R 3/28* | (2006.01) |

(52) U.S. Cl.

CPC ..... *F23R 3/002* (2013.01); *F01D 25/08* (2013.01); *F23R 3/04* (2013.01); *F05D 2220/32* (2013.01); *F23R 3/283* (2013.01); *F23R 2900/03044* (2013.01)

(58) Field of Classification Search

CPC .. F23R 3/10; F23R 3/002; F23R 3/283; F23R 3/04; F23R 3/06; F23R 2900/03044; F23R 2900/03042; F23R 3/007; F23R 3/005; F01D 25/08

See application file for complete search history.

(56) References Cited

U.S. PATENT DOCUMENTS

| | | | | |
|---|---|---|---|---|
| 2007/0186558 | A1* | 8/2007 | De Sousa | F23R 3/50 60/804 |
| 2012/0234013 | A1* | 9/2012 | Overman | F23R 3/343 60/772 |
| 2014/0318138 | A1* | 10/2014 | Bunel | F23R 3/283 60/752 |
| 2016/0215980 | A1* | 7/2016 | Chang | F23R 3/007 |
| 2017/0370584 | A1 | 12/2017 | Boardman et al. | |

FOREIGN PATENT DOCUMENTS

| | | |
|---|---|---|
| EP | 2 107 308 A1 | 10/2009 |
| FR | 2 998 038 A1 | 5/2014 |

* cited by examiner

*Primary Examiner* — Gerald L Sung
*Assistant Examiner* — Rodolphe Andre Chabreyrie
(74) *Attorney, Agent, or Firm* — Blank Rome LLP

(57) ABSTRACT

A combustion chamber for a gas turbomachine. The combustion chamber comprising inner and outer walls, a chamber bottom, and a heat shield arranged downstream of the chamber bottom, to protect it thermally. The inner and outer walls and the heat shield form a one-piece unit.

20 Claims, 4 Drawing Sheets

ONE-PIECE COMBUSTION CHAMBER

This application claims priority to French patent application no. 1856919, filed Jul. 25, 2018, the entirety of which is incorporated by reference herein.

TECHNICAL FIELD

This invention relates to a combustion chamber for a gas turbomachine, such as an aircraft turbojet or turboprop, wherein fluids (such as air and at least one fuel) generally flow from upstream to downstream to operate it.

BACKGROUND

In this field combustion chambers are known with:

an inner wall and an outer wall, and a chamber bottom (FDC; single- or double-walled) extending (on the upstream side) between said inner and outer walls and including first openings for mounting, on the chamber bottom, fuel injection devices adapted to inject fuel through said first openings, and a heat shield located downstream of the bottom wall, to protect it thermally, and having second openings for passing said fuel injection devices therethrough (i.e. configured for this purpose).

FR 2 998 038 discloses such a combustion chamber wherein there is a double-walled chamber bottom: upstream and downstream, with a space (or enclosure) between them, this space being supplied with air via multi-perforation holes, in order to ensure impact cooling of the downstream wall, which is directly exposed to the flame radiation. Air is then ejected through slots or holes towards the inner and outer walls to initiate an air film which is then relayed through the multi-perforation holes in these walls.

The chamber bottom which is directly exposed to radiation in this annular configuration is thus subjected to strong thermal stresses which will, over the course of the operating cycles, deform it and no longer allow it to satisfactorily perform its main function with regard to the upstream wall, especially since it is frequent to protect the chamber bottom thermally (with regard to the flame in the furnace) by a heat shield (or a ring of heat shields) mounted in the chamber, directly downstream of the bottom wall. Applied to previous solutions as in those in FIGS. 1, 2 (see below and item 21 or 21'), the term "heat shield" is to be considered as covering both a single piece and, as usually, a succession of sectors forming a protective ring, or a "heat shield ring".

Without a heat shield or sufficient thermal resistance over time of the downstream wall, the bottom of the chamber is normally likely to (too) quickly see its integrity altered. Clearance may appear, which generates problems of pollution, fuel consumption, and re-ignition of the chamber in case of extinction. The addition of a fail-safe safety system is also an inappropriate solution, which adds to the weight of the combustion chamber.

The purpose of the invention is therefore in particular to provide an effective and economic solution to at least some of these problems and disadvantages, by aiming to achieve at least some of the following objectives in relation to the prior art, for example FR 2 998 038:

improvement of the service life of the combustion chamber, reduction of parasitic gas leaks in the area of the equipped FDC, reduction of pollution, reduced fuel consumption, improvement of the ignition and re-ignition conditions of the chamber, control of the overall mass of the combustion chamber, mastery of the manufacturing of the combustion chamber, good mechanical resistance, improved resistance to thermal stresses.

It is therefore proposed that the inner and outer walls and the heat shield should form a one-piece unit.

And, it is also proposed that, towards the upstream end of the combustion chamber, it should be provided:

a cover extending upstream of the chamber bottom, and first metal inner and outer (intermediate) connecting walls respectively, connecting together the cover and the inner and outer walls respectively and to which are attached:

the chamber bottom (FDC), and said inner and outer walls.

The structural aspect of the CDF is thus used/valued. It is the "reference" fastening element. An appropriate stiffness is obtained.

In addition, it must also be possible to achieve effective control of the geometric tolerances of the furnace: elimination of welding operations, plasma metallization, etc. Thanks in particular to the one-piece aspect, it must be possible to ensure, for example in relation to the combustion chamber of FR 2 998 038, that the volume of the chamber is maintained in order to respect favourable re-ignition ceilings in the event of extinction in flight.

With this solution, the outer wall, a typical set of 20 baffles and the inner wall are replaced by a single part; the combustion chamber furnace becomes (essentially) closed at 360°, with a downstream opening opposite the DHP (high pressure nozzle). There may no longer be a distinct heat shield, separate from the bottom of the chamber. Leaks can be virtually eliminated between the inner/outer walls and the bottom of the chamber, and between sectorized baffles in relation to the situation of FR 2 998 038: The installation of a furnace more closed in its upstream part as compared to this situation of FR 2 998 038 eliminates inter-heat shield leakage by sector.

The term "chamber bottom" (FDC) has been used above and is also used to refer to the element 20" below:

in so far as it is (as in FR 2 998 038 for example) the element extending between said inner and outer walls and comprising first mounting openings for fuel injection devices towards the combustion chamber furnace; it is therefore to the FDC that the fuel injection devices passing through the upstream part of the combustion chamber are fastened; it is a structural bottom;

despite the fact that the heat shield will define a bottom for the combustion chamber furnace (since the above-mentioned inner and outer walls and heat shield form a one-piece assembly).

In this solution, this "bottom" of the furnace (marked 21" below) continues to act as a heat shield, protecting the "bottom of the chamber" (FDC), which is not directly exposed to thermal radiation. The term "heat shield" is therefore appropriate. The expression "bottom 21"' of the one-piece assembly" has also been used below to avoid any confusion with the above-mentioned "bottom of chamber" (FDC), while noting its conformation as the bottom.

Favourably, the above one-piece assembly will be made of (i. e. based on) a refractory material, which may be (may include) a ceramic matrix composite (CMC).

The wall thickness could be between 0.9 mm and 1.6 mm.

In terms of mass, a reduction by approximately 15-25% of the overall mass of the combustion chamber is then targeted as compared to that of FR 2 998 038.

This one-piece assembly does not need to be coated with a thermal protection barrier (especially in ytrium zirconate).

In this respect, the proposed solution must allow the "bottom" of the one-piece assembly to define a thermal protection for the FDC, which can remain structuring for the combustion chamber, i.e. as the bottom wall through which the forces to be passed mainly between the bottom zone of the chamber and said inner and outer walls surrounding the area where the flames develop in the combustion chamber.

In terms of the advantages of the above-mentioned one-piece assembly, we can still note:

- the removal of the thermal barrier in the furnace (previously on the equivalent of the inner and outer walls and sectorized baffles),
- a corresponding reduction in costs.

To further enhance the above advantages related to stress absorption, it is proposed that the heat shield part of said one-piece assembly be completely solid, thus not having cooling air passage openings to the inner and/or outer walls.

This allows the removal of the thermal barrier in the furnace, on the equivalent of the inner and outer walls and baffles in FR 2 998 038.

To further aim to eliminate leaks in the space between the FDC itself and the "bottom" of the one-piece assembly defined by the part forming the heat shield, the chamber bottom will be positively completely solid, thus being deprived of cooling air passage openings towards the part forming said heat shield of the one-piece assembly.

In this way, in particular, no welding or brazing; no resuming machining to make the previous holes in the FDC.

With a one-piece assembly, and especially one based on a refractory material, there is however a difficulty in the connection between the one-piece furnace (this assembly) and the metal parts around the turbomachine. In this respect, it is common to assemble two metal flanges with a bolted connection on which a tightening torque is applied. The approach did not seem appropriate for the present one-piece assembly. When a refractory material is used, in particular CMC, it was preferred to propose a bond where the refractory material is supported to be maintained in position in its environment, and thus avoid delamination of the material.

It is also recommended that, towards the downstream end of said chamber, second metallic (intermediate) walls are provided for inner and outer connection respectively, having inner and outer flanges, respectively, for connection between:

- said inner wall and:
  - an inner casing (such as the HP (high pressure) nozzle support casing), and/or a part of a turbomachine nozzle, and/or
  - a downstream arm of an air diffuser of the turbomachine, and/or
  - an inner web attached to said downstream arm, and
- said outer wall and, another part of said nozzle and/or an outer casing of the turbomachine.

In particular, said annular diffuser may be connected upstream to a (the) compressor where air admitted into the turbomachine is compressed before reaching the combustion chamber. The inner and outer casings may be those surrounding the combustion chamber, and extend around said (metal) inner and outer walls of this chamber.

On these metal intermediate walls, it will be possible in particular to:

- for the connections between said inner and outer walls of the one-piece assembly and the metal inner and outer connecting walls above, respectively, use pins and washers welded together,
- while the connections between the (metal) FDC, the (metal) cover and either the first metal inner connecting walls or the first metal outer connecting walls will preferably be provided a priori by screw nuts that will pass through them.

In a connection with the DHP, the welded pin and washer solution may be used to hold the outer flange and the inner flange only to provide a sealing connection with the DHP lamellae.

Between the bottom (said heat shield) of the one-piece assembly and the metal elements for mounting the fuel injection devices that pass through the FDC, which is itself metallic, there have been consequential problems of thermal stress, wear and brittleness, especially if the one-piece assembly is made of a refractory material.

SUMMARY

A solution provided consists

- in that, on the combustion chamber are provided:
  - sheaths arranged in the bottom chamber openings (FDC), the sheaths having upstream facing edges, and
  - washers through which said injection devices pass, such as the sheaths, and which individually delimit, with one edge of the corresponding sheath, an annular space wherein an annular edge of said injection device is accommodated and can slide in the radial direction, and
- in that in addition, an axial clearance is reserved between each sheath and said part forming the heat shield of the one-piece assembly.

With this clearance between the sheath of the equipped FDC and a furnace that can be made of CMC, any contact between the refractory material and the metal will be avoided, thus limiting mechanical risks on a large, fragile one-piece element.

According to another characteristic, it is proposed:

- that fuel injection systems are multipoint,
- and that said part forming the inner and outer walls, respectively, of the one-piece assembly is completely solid, thus being free of primary and dilution holes.

On this subject and as already mentioned, to produce the above-mentioned assembly in one-piece, and this a priori based on refractory material (s) must allow, compared to the current combustion chambers with metal (inner, outer and "ring of heat shields") walls, a maintenance of the chamber volume to respect the re-ignition ceilings; deformations on walls and flanges are limited (ovalization), in particular due to the higher temperature resistance of refractory materials (with CMC, T>2000° C.) and the advantages in terms of thermal transfer due to the one-piece characteristic. The upstream face of the furnace made of a refractory material no longer needs to be cooled as was the case with metal heat shields in the past, thus possibly eliminating the usual multi-perforation on metal chamber bottoms. It should be noted that the possible removal of primary holes and dilution holes is also due to the presence of a multipoint injection system: on metal combustion chambers, all primary or dilution hole openings generate crack initiation; removing these holes will improve the service life of the part.

In general, further advantages are also expected:

a reduction in cost (removal of the thermal barrier, multi-perforation, dilution zones, etc.), in the global mass, as well as a better control of the geometric tolerances of the furnace (elimination of welding operations, plasma metallization and multi-perforations . . . )

In addition to the combustion chamber just presented, the invention also relates to a gas turbomachine for an aircraft equipped with this combustion chamber.

The term having been used, it is specified that the fuel injectors called "multipoint" are new generation injectors that allow adaptation to the various speeds of the turbomachine. Each injector has two fuel systems: the one called "pilot" which has a permanent flow optimized for low rpm and the one called "multipoint" which has an intermittent flow optimized for high rpm. The multipoint system is used when additional engine thrust is required, particularly in the cruise and aircraft take-off phases.

The invention also relates to a combustion chamber for a gas turbomachine, the combustion chamber comprising:

an inner and an outer wall, a chamber bottom extending between said inner and outer walls and including first mounting openings for fuel injection devices to inject fuel through said openings, and a heat shield arranged downstream of the chamber bottom, to protect it thermally, and having second mounting openings for the fuel injection devices, wherein said inner and outer walls and said heat shield form a one-piece assembly and the chamber bottom forms a ring presenting itself as a circumferential succession of sectors.

The realization in a succession of sectors is useful for stress management, taking into account the one-piece design of said inner and outer wall/heat shield assembly, and all the more so (as already mentioned above):

if this one-piece assembly is made of a refractory material, and if the combustion chamber further comprises a first metal inner connecting wall and a first metal outer connecting wall, connecting together the chamber bottom and the inner wall, and, the chamber bottom and the outer wall, respectively.

This is why another aspect of the invention relates to a combustion chamber for a gas turbomachine, the combustion chamber comprising:

an inner and an outer wall, a chamber bottom extending between said inner and outer walls and including first mounting openings for fuel injection devices to inject fuel through said openings, and a heat shield arranged downstream of the chamber bottom, to protect it thermally, and having second mounting openings for the fuel injection devices, wherein said inner and outer walls and said heat shield form a one-piece assembly, and wherein the combustion chamber further comprises a first metal inner connecting wall and a first metal outer connecting wall which the chamber bottom and the one-piece assembly are fastened to.

BRIEF DESCRIPTION OF THE FIGURES

The invention will be better understood, if need be, and other details, characteristics and advantages of the invention will appear upon reading the following description given by way of a non restrictive example while referring to the appended drawings wherein.

DETAILED DESCRIPTION

Figure 1:
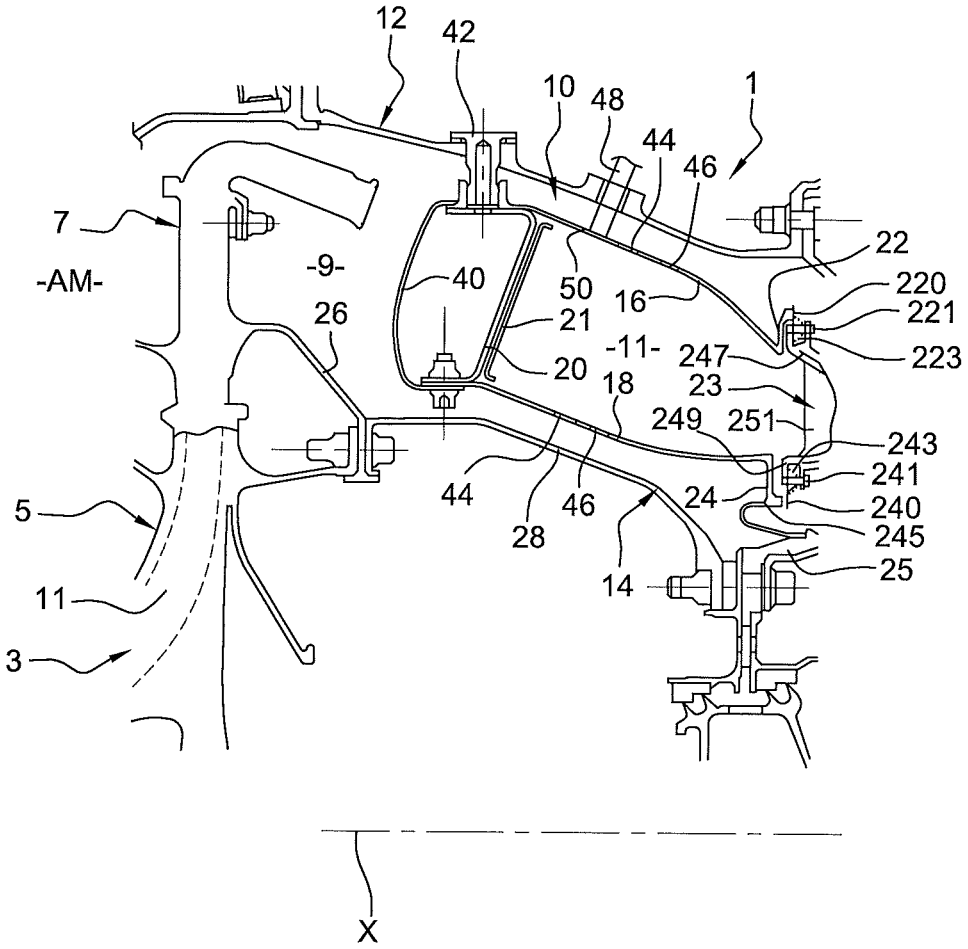
FIG. 1 is a schematic half-view in axial section of a "combustion module" of a turbomachine, comprising a combustion chamber of the prior art.

In the embodiment shown in FIG. 1, the part 1 of the turbomachine includes a compressor 3—which can be a high-pressure compressor arranged axially, following a low-pressure compressor—the downstream part of which (visible in the figure) includes a centrifugal stage 5, and an annular diffuser 7 connected downstream of the compressor 3. The diffuser 7 opens into a space 9 surrounding an annular combustion chamber 10. The space 9 is delimited by an outer casing 12 and an inner casing 14, both annular and coaxial to the X axis of the turbomachine. The combustion chamber 10 is held downstream by fixing flanges. This part 1 of the turbomachine can be called a "combustion module".

The compressor 3 is centrifugal and includes a rotary impeller 11 designed to accelerate the air flowing through it and thereby increase the kinetic energy of the air. The compressed air introduced into the combustion chamber 10 is mixed with fuel from injectors, such as the injectors 4 in FIG. 2. The gases from the combustion are directed to a (here high pressure) turbine located downstream (AV) of the outlet of the chamber 10, and first to a nozzle 23 which is part of the stator of the turbomachine.

The diffuser 7 annularly surrounds the impeller. The diffuser 7 is used to reduce the speed of the air leaving the impeller and thereby increase its static pressure.

The chamber 10 consists of a metal outer revolution wall 16 and a metal inner revolution wall 18, connected upstream to an annular transverse wall 20, or a chamber bottom wall. Thanks to (radially) outer 22 and inner 24 annular flanges respectively, and at the downstream end, the chamber 10 is in axial support against outer and inner annular shrouds respectively, of a nozzle, here the high pressure nozzle 23, via sealing lamellae 220, 240 connected to said (radially) outer 22 and inner 24 annular flanges, respectively. These flanges axially bear against axial pins 221, 241, respectively, which are fitted to the outer and inner ring shrouds 247 and 249 and can be centred by springs 223, 243. As the outer annular flange could do externally, the radially inner annular flange 24 extends radially inwardly with respect to the sealing lamellae 240 by a pin-shaped annular support member 245 opening in the downstream direction which bears against a casing 25, called the HP nozzle support casing. Between the outer and inner annular shrouds of the nozzle 23, which is also attached, there are substantially radial blades 251.

It can be considered that the inner casing 14 along the chamber 10 is defined by, or includes, a diffuser shroud 26 and an inner intermediate web 28 attached upstream to the shroud 26 and downstream to the casing 25.

In the example in FIG. 1, the combustion chamber 10, the downstream end of which is positioned as shown above, is also fastened upstream (AM) by at least three fastening pins 42 circumferentially distributed around the longitudinal X axis of the turbomachine, around which axis the turbine (s) and compressor (s) blades rotate.

The radial aspect will, in this application, be assessed in relation to axes X and I-I', the axial aspect being therefore assessed in reference to one or other of said axes, the axis of revolution of the combustion chamber being itself parallel to (combined with) the longitudinal axis of the turbomachine. As regards this point, the expressions external/outer internal/inner should be understood as with regard to the radial direction.

The pins 42 are fastened to the outer casing 12 and at least to the walls 16, 20 fastened together. Preferably, there are four such pins 42 distributed uniformly around the X axis.

While the cross-section in FIG. 1 does not show a fuel injection device, it does show a cover 40 that can be annular and curved in the upstream direction. The cover 40 is attached to the upstream ends of the walls 16, 18 and 20 of the chamber. Following another circumferentially displaced section that would pass through the axis of one of these fuel injection devices, as shown in FIG. 2, it could be seen that the cover 40 includes air passage openings (reference 41" FIG. 3, 5, 9) and said fuel injection device aligned with other passage openings provided through the chamber bottom wall 20 and a heat shield 21 (replacing the front heat shield ring) disposed immediately downstream thereof, to thermally protect it from the radiation of flames developing in the furnace 11 of the chamber 10.

Figure 2:
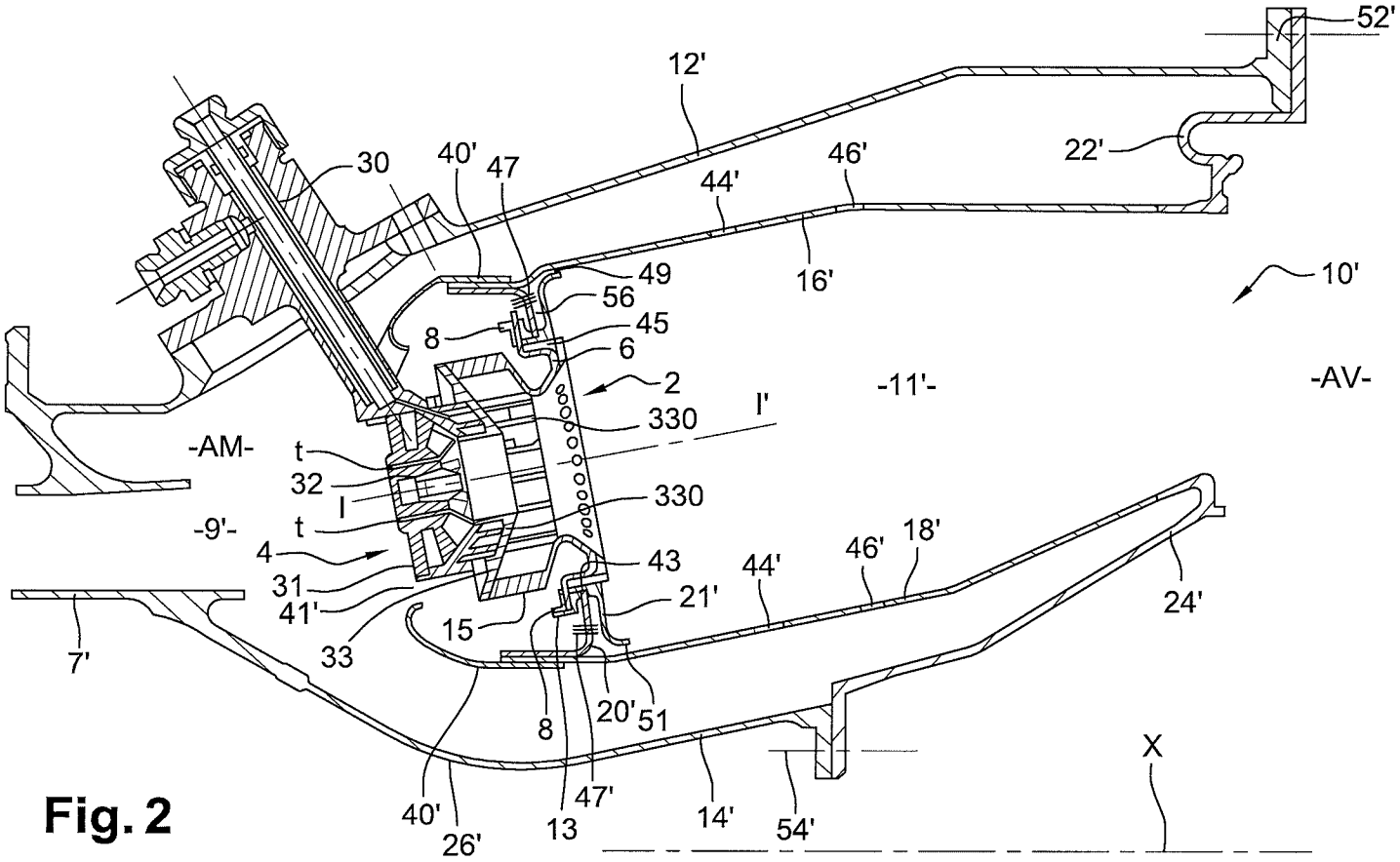
FIG. 2 is an identical view to that of FIG. 1, with an angular deviation, of an alternative arrangement of the combustion module of the prior art.

FIG. 2 also illustrates both an example of a different mounting of a combustion chamber and an example of a "multipoint" fuel injector. Identical means or means performing the same function as those in FIG. 1 are identically referenced, with the exception of an exponent"".

An injector 4 is mounted in each of the plurality of injection systems 2. A combustion chamber of revolution usually includes a large number of injectors 4 circumferentially distributed around the X axis.

Each injection system 2 includes a bowl 6 diverging towards the furnace 11' of the chamber 10' (downstream/AV) to burst the outgoing jet of the mixture of air and fuel, a floating ring 8 for sliding the bowl 6 into the anchoring sheath 13, one or more spins 15 allowing to introduce air with a turning movement. Each multipoint injector 4 essentially comprises a fuel supply arm 30, one or more spin stage(s) 31 allowing, like the spins 15 of the injection system, to introduce air with a turning movement, a fuel nozzle 32 placed on the I-I' axis of the injector 4 and a network 33 of n fuel injection ports 330 drilled at the periphery of the injector 4. Each injector 4 is fastened to the walls 16', 18' and is mounted in an injection system 2 described above. More precisely, the supply arm 30 is fixed to the casing 12' in such a way that the network 33 of injection ports 330 is mounted in the upstream part of the spin body 15. The assembly is thus mounted in such a way that there is a precise centering (and therefore concentricity) between the injector 4 and its associated injection system 2. If necessary, a multipoint injector 4 has one or more purge hole(s) t for introducing air axially into the injection system 2.

A multipoint injector 4 is therefore designed to include, on the one hand, a fuel nozzle 32 arranged along its axis that injects fuel at a permanent flow rate, and on the other hand, multipoint orifices 330 drilled at the periphery of the injector that inject fuel at an intermittent rate for high engine speeds. The fuel "pilot system" designed to supply the nozzle 32 is also used to cool the fuel system designed to supply the multipoint orifices 330.

The air diffuser 7' opens into a space 9' along the axis of the I-I' axis of the injector 4.

Like the cover 40, the cover 40' is crossed by openings 41' for mounting the injectors 4, which receive a mixture of air and fuel. Coaxially, first and second openings 43, 45 respectively pass through the chamber bottom 20' and the heat shield 21', which can be a ring in one or more parts, circumferentially. Each opening is coaxial with the axis of the injector concerned, the axis I-I' FIG. 2, which is also that of the fuel nozzle 32, on the same FIG. 2. The first and second openings 43, 45 allow the injectors 4 (axes I-I') to be mounted axially, but also to allow air from the volume 9' to pass therethrough, so that the furnace 11' receives the appropriate air/fuel mixture, part of the air in the furnace also coming from the primary and/or dilution holes 44', 46', but also in this case from passages 49, 51 (see below).

With metal outer 16' and inner 18' walls, these walls are traversed by primary holes and dilution holes 44', 46' (which were already present in FIG. 1 in 44, 46). In addition, the chamber bottom 20' is traversed by multi-perforation holes 47 leading into the space 56 between the elements 20', 21', allowing air from the volume 9' to cool the heat shield 21', before passing, in 49, 51, between the radial ends of this heat shield 21' and the outer 16' and inner 18' walls, respectively to form an air film.

In both the solution in FIG. 1 and FIG. 2, the mixture of air and fuel injected into the combustion chamber furnace is ignited by at least one spark plug (48 FIG. 1) that extends radially outside the chamber. The spark plug 44 is guided at its radially inner end into an orifice 1 of the outer chamber wall 16.

In the solution in FIG. 2, the combustion chamber is suspended on the upstream side (AM) and fastened on the downstream side (AV) by flanges 22', 24' to attach the outer 16' and inner 18' walls to the outer 12' and inner 14' casings, respectively. Screws 52', 54' maintain and take up the forces.

Figure 3:
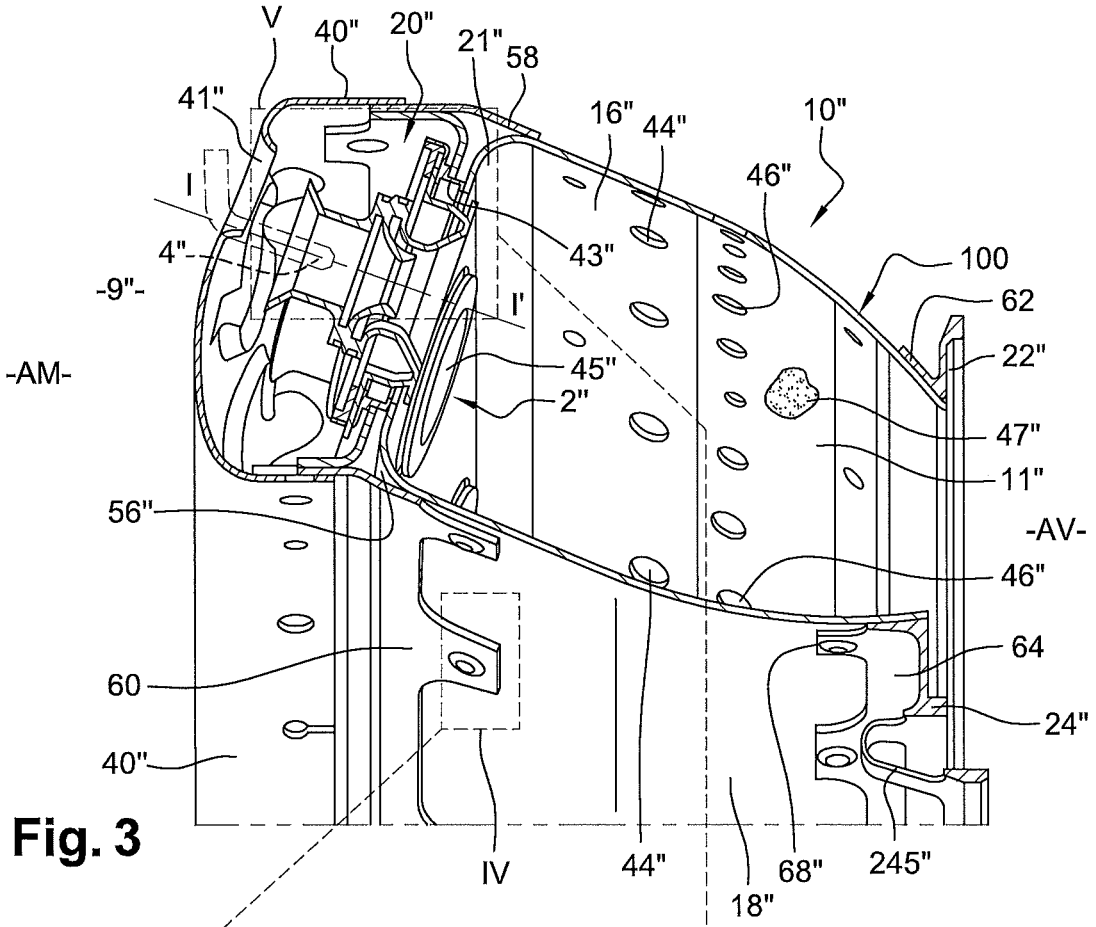
FIG. 3 is a view corresponding to FIG. 2, but also showing the perspective of one embodiment of a combustion chamber according to the invention, FIG. 4 corresponds to the detail IV of FIG. 3.
Figure 6:
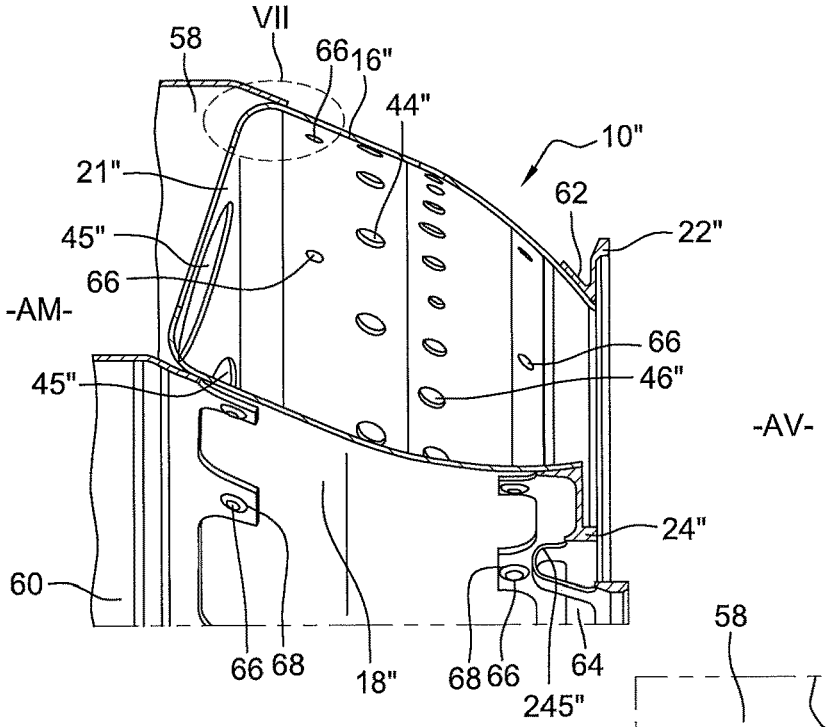
FIG. 6 is based on FIG. 3, but without the cover, the bottom of the chamber and part of the fuel injection devices shown in FIG. 3.

To overcome the disadvantages mentioned at the beginning of the text, and in particular to improve the service life of the combustion chamber and/or reduce parasitic gas leaks in the area of the equipped FDC and/or better control the overall mass of the combustion chamber, it is first proposed, rather than locally adapting one aspect or another, for example, of one of the combustion chambers 10, 10', to make said inner and outer walls and said at least one heat shield—arranged downstream of the bottom wall to protect it thermally—so that they jointly form a one-piece assembly, as shown in FIG. 3 or 6, where the identical means or means fulfilling the same function as those in FIG. 1 or FIG. 2 are identically referenced, within an exponent"".

It can thus be seen in FIG. 3 or 6, a combustion chamber 10" with inner 16" and outer 18" walls and a heat shield 21" formed as a one-piece assembly 100.

The one-piece assembly 100 is made of a refractory material including CMC.

The bottom, consisting of the heat shield part 21", of the one-piece assembly defines a thermal protection for the FDC 20", which, as it is metallic and has a thickness greater than or equal to that of the one-piece assembly 100, is mechanically structuring for the combustion chamber.

The shape, parallel to each I-I" axis of the injector 4" of the injection system, 2" of the one-piece assembly 100 is substantially frustoconical in the downstream direction.

(In particular) to eliminate air leaks in the space 56" between the FDC 20" and the bottom 21" of the one-piece assembly, this bottom 21" is here entirely solid, except for the second openings 45". The heat shield 21" thus has no through holes (see points 49, 51 FIG. 2) for cooling air towards the outer 16" and/or inner 18" walls.

Figure 8:
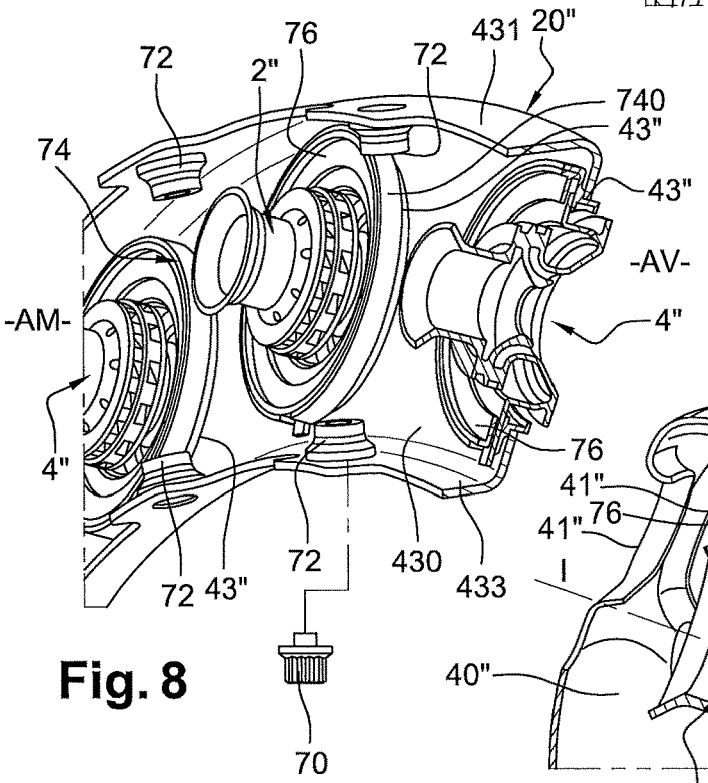
FIG. 8 only shows the chamber bottoms, part of the fuel injection devices shown in FIG. 3, with the fixing nuts of said first metal outer connecting walls (58 below)

In addition, the refractory material-based construction of the one-piece assembly 100 may allow that, with the exception of said first mounting openings 43" of the fuel injection devices 2"/4" (see FIGS. 3, 5), the bottom of the chamber 20" will be completely solid, thus not having cooling air passage openings (multi-perforations 47 FIG. 2) towards the part forming the ring 20" of heat shields; see FIG. 8 in particular. In this FIG. 8, it can also be noted that the ring 20" can look like a circumferential succession of sectors (ring sectors). Each sector may include a solid radial wall 430 (excluding openings 43") extended in the upstream direction by outer 431 and inner 433 fixing edges.

Figure 5:
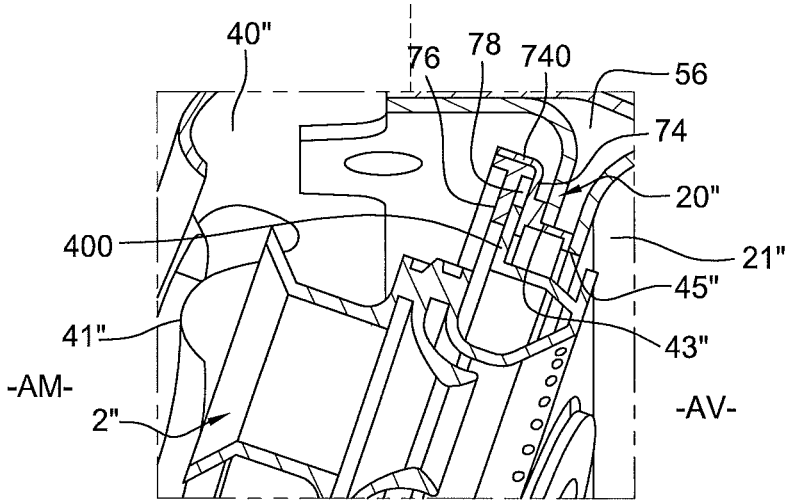
FIG. 5 corresponds to the detail V of FIG. 3.
Figure 9:
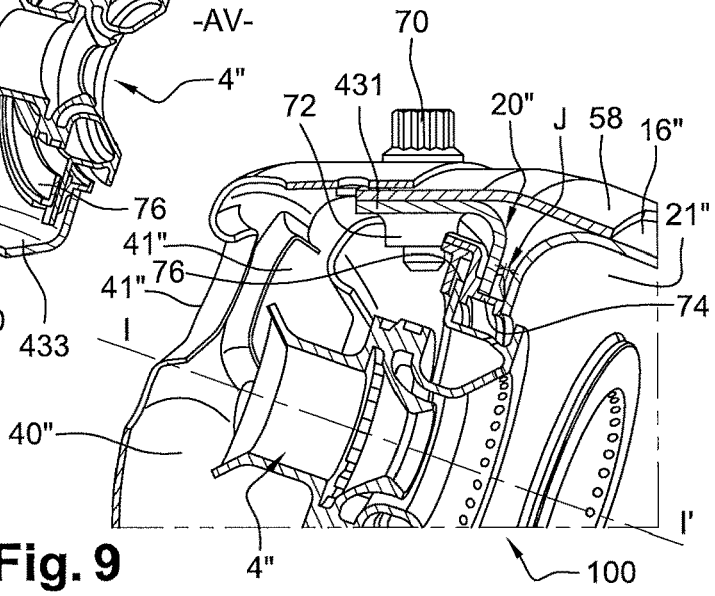
FIG. 9 shows the same view as FIG. 5, but from a different angle and showing the attaching screws/nuts of these same first metal walls.

For a connection—with controlled (mechanical/thermal) stresses and manufacturing—between the one-piece assembly 100 and the metal parts around the turbomachine (if they exist: pins 42, lamellae 220, 240, edges of the arms 26" and/or the outer casing 12" for fixing via the screws 54', 52" . . . ), it is proposed that, towards the upstream end of the combustion chamber 100, first metal inner connecting walls 60 and outer connecting walls 58, respectively, will be provided, connecting the metal cover 40'" (which extends upstream of the chamber bottom 20") and the inner walls 18" and outer walls 16", respectively, together; see FIGS. 3, 5 and 9.

In addition, towards the downstream end of said chamber, second metal inner connecting walls 64 and outer connecting walls 62 are provided respectively (see FIG. 3), having inner 24" and outer connecting 22" flanges, respectively:

- between said inner wall 18" and:
  - the injector casing (marked 25 in FIG. 1, via a possible pin part 245") and/or the inner annular ring 249 (FIG. 1),
  - an intermediate inner web (mark 28 FIG. 1 and/or flanges 24' FIG. 2),
  - a downstream arm (marked 26' in FIG. 2) of the annular air diffuser (marked 7' in FIG. 2), and
- between said outer wall 16" and a part of the DHP (outer annular shell 247 FIG. 1), and/or the outer casing (marked 12' in FIG. 2), in particular a clamping area on this outer casing.

The metal connecting walls 58, 60, 62, 64 will therefore be flexible sheets, more deformable than the refractory material of the assembly 100, when the turbomachine is in operation.

The downstream positioning of these metal connecting walls will therefore be favourable, or even necessary, to ensure water-tightness with the DHP sectors 23 (FIG. 1) and, upstream, to maintain the combustion chamber on the chamber casing, if the fastening of the combustion chamber is as the one 10 in FIG. 1.

In any case, it could be planned to combine fasteners together; for example, extend the outer flange 22" to attach it to the outer casing 12 (FIG. 1), and/or attach the pin part 245" to the intermediate inner web 28. It would therefore also be possible to provide fastenings (such as those 52', 54' in FIG. 2) between the outer 22" and/or the inner 24" and the outer 12 (12') flanges and/or inner 14 (14') casings, respectively (FIG. 1 or 2).

Figure 4:
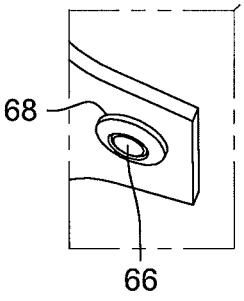
Figure 7:
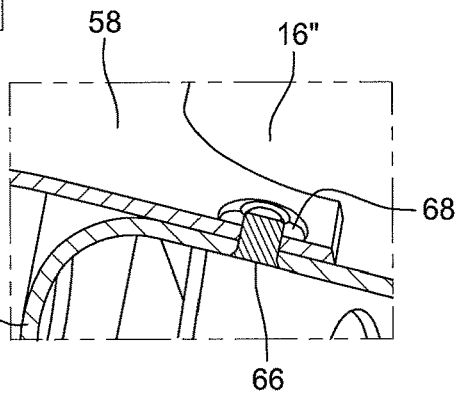
FIG. 7 shows details of the area VII in FIG. 6 from a different perspective.

Again for the issues of connection with controlled mechanical/thermal stresses and simplified manufacture (due to the dissociation of the parts: assembly 100 on the one hand and metal connecting walls, 58 to 64, on the other hand, pins 66 and washers 68 welded together can in particular be used for the connections between said inner walls 18" and outer walls 16" of the one-piece assembly 100 and the metal inner 60, 64 and outer 58. 62 connecting walls respectively; see FIGS. 4, 6, 7.

On the other hand, the (metal) connections between the FDC 20", the (metal) cover 40" and respectively the first metal inner connecting walls 60 and the first metal outer connecting walls 58, will preferably be provided a priori by screw-nuts 70, 72 that will pass through them.

FIG. 8, only one screw 70 is shown; but each nut 72 is associated with one such screw, which passes through coaxial radial holes provided in the first metal wall 60 or 58, the cover 40" and the corresponding flange 431 or 433; see FIG. 9.

On the downstream side, the solution with pins 66 and washers 68 welded together will make it possible to maintain the downstream metal inner connecting walls 64 and outer connecting wall 62 only to ensure a watertight connection with the lamellae 220, 240 of the DHP 23, if such a connection is provided (cf. FIG. 1).

To limit thermal stresses, wear and tear and fragility between the bottom 21" of said one-piece assembly 100 and the metal elements (15 . . . ) for mounting the fuel injection devices that pass through the FDC 20", and even more so with a one-piece assembly based on a refractory material, it is proposed:

- that, on the combustion chamber 100, should be provided:
  - sheaths 74 arranged in the openings 43" of the bottom of the chamber (FDC), the sheaths having upstream-facing edges 740, and
  - washers 76 crossed, as the sheaths 74, by said injection devices 2"/4" and individually delimiting, with one edge 740 of the corresponding sheath, 74 an annular space 78 wherein an annular edge 400 of a said injection device is housed and can slide in the radial direction,
- and that in addition an axial clearance J should be reserved between each sheath 74 and said part 21" forming the heat shield of the one-piece assembly 100.

Any contact between the fragile refractory material and the metal will thus be avoided.

In the example shown in FIGS. 3, 8, 9, the fuel injection devices are not multipoint (marked 2" in FIG. 3), but "conventional", like those of FR 2 998 038.

The part(s) forming the inner 18" and/or outer 16" walls, respectively, of the one-piece assembly 100 is/are traversed by primary holes 44" and dilution holes 46" that open into the furnace 11". Some multi-perforation holes 47", to inject cooling air into the furnace, were also shown locally. If they exist, they extend over a much larger area, as known.

However, fuel injection devices 2" can be multipoint (with injectors 4") (see FIG. 2, device 2).

If the fuel injection devices 2" are multipoint (with injectors 4"), then said part forming the inner 18" and/or outer 16" walls, respectively, of the one-piece assembly 100 may be completely solid, thus with no primary and dilution holes.

Thus, due to the one-piece nature of the assembly 100, its construction (preferably a refractory material) and a multi-point fuel injection, such holes 44" and/or 46" in the walls 18" and/or 16" could be avoided. Moreover, this is the case in FIGS. 3, 6 where the inner wall 18" is with no primary hole, dilution hole or multi-perforation hole.

The invention claimed is:

1. A combustion chamber for a gas turbomachine, the combustion chamber comprising:

an inner wall and an outer wall, a combustion chamber bottom extending between said inner wall and outer wall and comprising first openings for mounting on said combustion chamber bottom fuel injection devices adapted for injecting fuel through said first openings;

a heat shield arranged downstream of the combustion chamber bottom to thermally protect, the combustion chamber bottom, the heat shield having second openings for passing the fuel injection devices therethrough, wherein said inner will, said outer will and said heat shield form a one-piece assembly;

a cover extending upstream of the combustion chamber bottom; and a first metal inner connecting wall and a first metal outer connecting wall connecting together the cover, and to which are attached: the combustion chamber bottom, and said inner wall and outer wall, respectively, wherein a downstream end of the respective first metal inner connecting and first metal outer connecting wall overlaps and is affixed to an upstream end of the respective inner will and outer wall.

2. The combustion chamber of claim 1, wherein said one-piece assembly is made of a refractory material.

3. The combustion chamber of claim 1, wherein the heat shield of said one-piece assembly is completely solid, except at a location of said second openings, said heat shield being thus deprived of cooling air passage openings towards the inner wall and/or outer wall.

4. The combustion chamber according to claim 1, wherein, except the first openings, the combustion chamber bottom is completely solid, thus being deprived of cooling air passage openings towards the heat shield of the one-piece assembly.

5. The combustion chamber of claim 1, wherein the attachments between the chamber bottom, the cover and either the first metal inner connecting wall or the first metal outer connecting wall include screw-nut connections.

6. The combustion chamber of claim 1, further comprising sheaths arranged in said first openings of the combustion chamber bottom, the sheaths having upstream-facing edges, and washers through which said injection devices pass, together with the sheaths, the washers individually delimiting, with a flange of the corresponding sheath, an annular space wherein an annular flange of one of said injection device is accommodated and can slide in the radial direction, and wherein an axial clearance is reserved between each sheath and the heat shield of said one-piece assembly.

7. The combustion chamber of claim 1, wherein the part forming the inner wall and outer wall, respectively, of said one-piece assembly is entirely solid, thus having neither primary and holes or dilution holes, and the injection devices are multipoint.

8. The combustion chamber of claim 1, wherein the combustion chamber bottom defines a ring formed by a circumferential succession of sectors each comprising a solid radial wall, excluding the first openings and extended upstream by an outer edge and an inner fixing edge.

9. A gas turbomachine for an aircraft, provided with the combustion chamber according to claim 1.

10. The combustion chamber according to claim 1, wherein welded pin-washers connect:

the respective first metal inner connecting wall and first metal outer connecting wall, and the respective inner wall and outer wall, at the respective overlaps.

11. The combustion chamber according to claim 1, wherein a downstream end of the cover overlaps an upstream end respective of the first metal inner connecting wall and first metal outer connecting wall.

12. A combustion chamber for a gas turbomachine, the combustion chamber comprising:

an inner wall and an outer wall, a combustion chamber bottom extending between said inner wall and outer wall and comprising first openings for mounting on said combustion chamber bottom fuel injection devices adapted for injecting fuel through said first openings, and a heat shield arranged downstream of the combustion chamber bottom, to protect thermally the heat shield, and the heat shield having second openings for passing the fuel injection devices there through, wherein said inner wall and outer wall and said heat shield form a one-piece assembly and the combustion chamber bottom forms a ring comprising a circumferential succession of sectors, and wherein a downstream end of the respective first metal inner connecting wall and first metal outer connecting wall overlaps and it affixed to an upstream end of the respective inner wall and outer wall.

13. The combustion chamber of claim 12, wherein said one-piece assembly is made of a refractory material.

14. The combustion chamber of claim 12, further comprising a first metal inner connecting wall and a first metal outer connecting wall, which connect therebetween respectively:

the combustion chamber bottom and the inner wall, and the combustion chamber bottom and the outer wall.

15. The combustion chamber of claim 12, which further comprises a second metal inner connecting wall and a second metal outer connecting wall, having respectively an inner connecting flange and an outer connecting flange, for connections respectively, between:

said inner wall and:

a casing and/or a part of a nozzle of the turbomachine, and/or a downstream arm of an air diffuser of the turbomachine, and/or an inner web attached to said downstream arm, and said outer wall and another part of said nozzle and/or an outer casing of the turbomachine.

16. A combustion chamber for a gas turbomachine, the combustion chamber comprising:

an inner wall and an outer wall;

a combustion chamber bottom extending between said inner will and outer will and including first mounting openings for mounting on the combustion chamber bottom fuel injection devices adapted to inject fuel through said first openings;

a heat shield arranged downstream of the combustion chamber bottom, to protect thermally the heat shield, and the heat shield having second openings for passing the fuel injection device therethrough, wherein said inner wall and outer wall and said heat shield form a one-piece assembly; and a first metal inner connecting wall and a first metal outer connecting wall which the combustion chamber bottom and the one-piece assembly are attached to, wherein a downstream end of the respective first metal inner connecting wall and first metal outer connecting wall overlaps and is affixed to an upstream end of the respective inner wall and outer wall.

17. The combustion chamber of claim 16, which further comprises a second metal inner connecting wall and a second metal outer connecting wall having respectively an inner flange and an outer flange for connections respectively between:

said inner wall and:

at least one of a casing and a first part of a nozzle of the turbomachine, and/or a downstream arm of an air diffuser of the turbomachine, and/or an inner web attached to said downstream arm, and said outer wall and at least one of a second part of said nozzle and an outer casing of the turbomachine.

18. The combustion chamber of claim 16, wherein said one-piece assembly is made of a refractory material.

19. The combustion chamber according to claim 16, wherein welded pin-washers connect:

the respective first metal inner connecting wall and first metal outer connecting wall, and the respective inner wall and outer wall, at the respective overlaps.

20. The combustion chamber according to claim 16, wherein a downstream end of the cover overlaps an upstream end respective of the first metal inner connecting will and first metal outer connecting wall.

* * * * *